US005297613A

United States Patent [19]

Uebber et al.

[11] Patent Number: 5,297,613

[45] Date of Patent: Mar. 29, 1994

[54] PROCESS AND APPARATUS FOR PRODUCING ROTATIONALLY SYMMETRICAL BODIES

[75] Inventors: Norbert Uebber, Langenfeld; Hans-Joachim Kreymann, Krefeld, both of Fed. Rep. of Germany

[73] Assignee: Mannesmann Aktiengesellschaft, Dusseldorf, Fed. Rep. of Germany

[21] Appl. No.: 964,619

[22] Filed: Oct. 21, 1992

[30] Foreign Application Priority Data

Oct. 22, 1991 [DE] Fed. Rep. of Germany ..... 4135194

[51] Int. Cl.[5] ..... B22D 23/00

[52] U.S. Cl. ..... 164/457; 164/46; 164/155

[58] Field of Search ..... 164/457, 46, 155; 118/320, 321, 679, 686; 427/422, 425

[56] References Cited

U.S. PATENT DOCUMENTS 5,054,539 10/1991 Keutgen et al. ..... 164/46

*Primary Examiner*—Kuang Y. Lin

*Attorney, Agent, or Firm*—Schweitzer Cornman & Gross

[57] ABSTRACT

A method for producing a rotationally symmetrical body from a molding material, such as a molten metal, which comprises atomizing the molding material in liquid form through a spraying nozzle that is disposed relative to a spray receiving the sprayed molding material on an initial position of said surface, forming a level of liquid molding material on said spray receiving surface and molding material, forming a controllably rotating body of said liquid molding material while it is solidifying, said solidifying rotating body having a diameter, drawing the so-formed body downwardly from said initial position while continuing its rotation, continuously forming said body at said initial position, monitoring the diameter values of the rotating body at a plane adjacent to said initial position, and controlling said rotation by said diameter values.

6 Claims, 1 Drawing Sheet

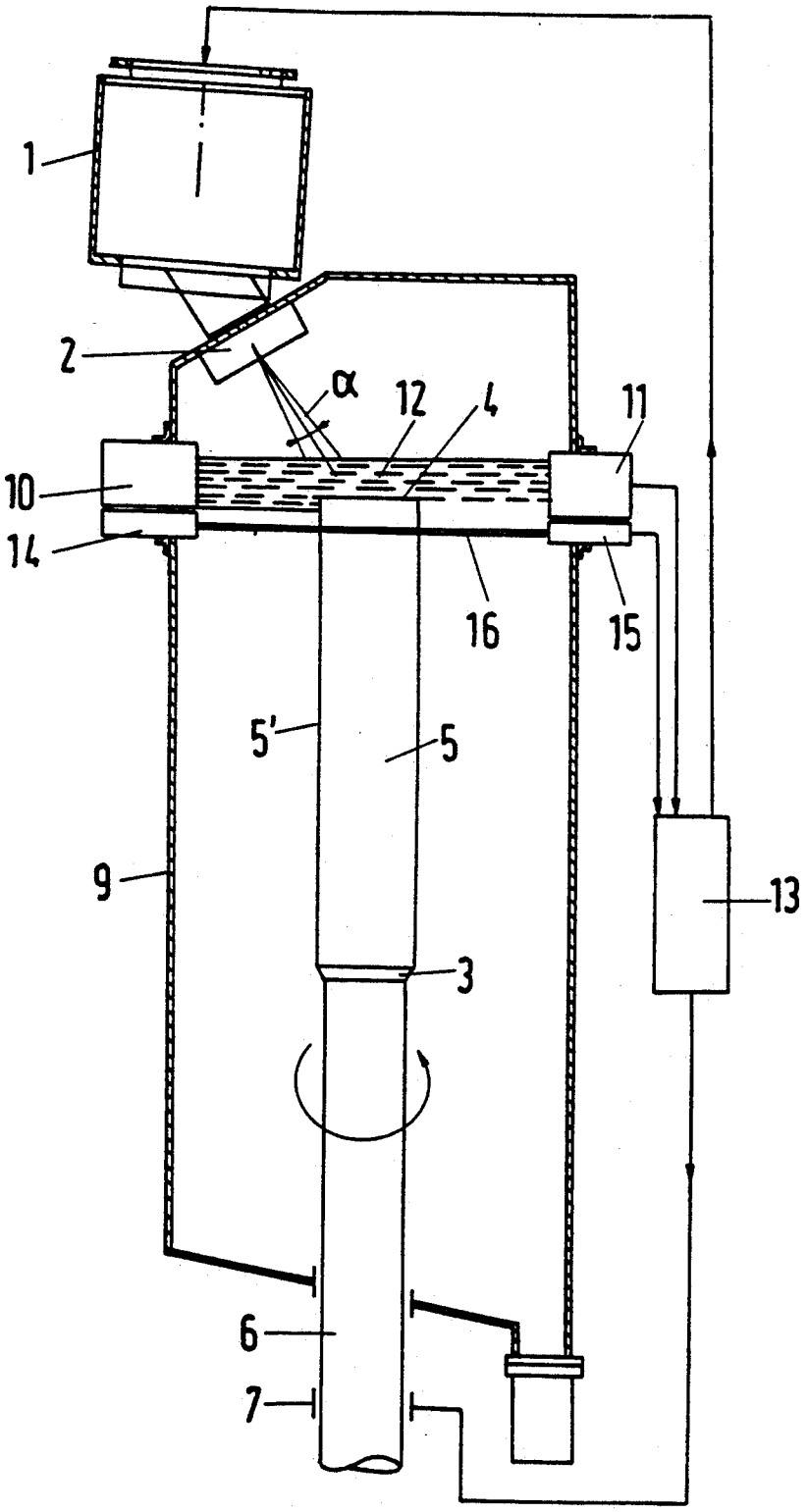
1
2
α
12
4
11
10
14
16
15
5'
5
9
13
3
6
7

PROCESS AND APPARATUS FOR PRODUCING ROTATIONALLY SYMMETRICAL BODIES

FIELD OF THE INVENTION

The invention relates to a process and apparatus for producing rotationally symmetrical bodies.

BACKGROUND OF THE INVENTION

The present invention is an improvement of the process and apparatus described in German patent publication No. 3,916,115 A1.

In the known methods of forming rotationally symmetrical bodies by drawing from a pool of liquid molding material, disturbances can occur due to solidification of some metal droplets on the spraying orifice, wear, spalling of refractory material at the outlet of the molten metal melt container, or any other change in operating characteristics from melt to melt. These affect the consistency of flow of sprayed molding material in the process. Such a change in the consistency of flow of material can detrimentally affect the geometry of the product being formed.

Therefore, it is the object of the present invention to improve the known process and apparatus, and thus improving the dimensional stability of the diameter the formed product.

BRIEF DESCRIPTION OF THE INVENTION

The present invention relates to a method for producing a rotationally symmetrical body from a molding material, such as a molten metal, which comprises atomizing the molding material in liquid form through a spraying nozzle that is disposed relative to a spray receiving surface for receiving the sprayed molding material on an initial position of said surface, forming a level of liquid molding material on said spray receiving surface and the molding material received thereon, forming a controllably rotating body of said liquid molding material while it is solidifying, said solidifying rotating body having a diameter, drawing the so-formed body downwardly from said initial position while continuing its rotation, continuously forming said body at said initial position, monitoring the momentary diameter of the rotating body at a plane adjacent to said initial position, and controlling said rotation by said momentary diameter.

The invention further relates to an apparatus for producing a rotationally symmetrical body for a molding material, such as molten metal, comprising a container for molding material, a spray orifice for atomizing molding material, a rotatable spray receiving surface spaced from said orifice for receiving the atomized molding material, a chamber surrounding said orifice and said spray receiving surface, means for determining the level of the spray receiving surface, means for monitoring the diameter of the forming body, and a controller, each of said means for determining and said means for monitoring being connected to said controller.

DRAWING AND DETAILED DESCRIPTION

The invention is further described in greater detail with reference being had to the sole FIGURE, showing a schematic view of the apparatus of the present invention.

Although the process and apparatus of the present invention can be employed with a large variety of molding materials, the process and apparatus are further described herein with reference to the molding material being suitably a molten metal.

The melt is stored in a molten metal supply container 1. The molten metal exits through an opening in the bottom of the container to reach a spray head 2 containing a spray orifice. The spray head, which may be tilted at a tilting angle $\alpha$, is adapted to spray the molten metal onto a rotatable spray receiving surface 3 in its initial, topmost position. Tilting the spray head 2 about the tilting angle $\alpha$ effects the complete coverage of the spray receiving surface 3 with sprayed metal. A rotationally symmetrical body can be formed due to the rotation of the rotatable spray receiving surface 3. At the time of starting the forming of the rotationally symmetrical body, the level 4 of the sprayed metal pool on the spray receiving surface, as well as the diameter of the product being formed, both become defined.

During the formation of the rotational body 5 it is drawn downwardly together with the spray receiving surface 3, while the level 4 of molten metal is maintained at the initial position over the free frontal side of the rotational body 5 as it is formed.

The initial rotatable spray receiving surface 3 is mounted from a supporting rod 6 which both rotates and vertically moves the initial rotatable spray receiving surface. The supporting rod 6 is attached to moving mechanism 7 which is adapted to rotate as well as to lift and to lower it.

The orifice 2 and the spray receiving surface 3 are contained within a containment chamber 9. The vertical position of the initial rotatable spray receiving spray receiving surface 3 and of the level of sprayed metal pool 4 are determined by a measuring apparatus comprised of a radiation transmitter 10 and receiver 11 arranged so that the surface 3 or the formed body 5 are in the path of the beam 12 that passes from the transmitter 10 to the receiver 11.

In accordance with the present invention there are also attached to the walls of the containment chamber 9 a sender 14 for producing a light beam 16 which proceeds parallel to the initial position of the spray receiving spray receiving surface 3, and is received by an acceptor 15 containing a light sensitive cell. The sender 14 and the acceptor 15 are arranged so that they are located closely below the spray level 4, and the light beam 16 is partially interrupted by the contour 5' of the outer surface of the formed body 5, thus being indicative of the diameter thereof.

When dealing with large diameter bodies 5, suitably two pairs of senders 14 and acceptors 15 are employed, the positions of which can be adjusted according to the instantaneously expected diameter of the body 5 and can be so adjusted that each pair of senders and acceptors scan a circumferentially opposite side of the cylindrical body 5.

When the temperature of the produced cylindrical body is sufficiently high, it will create its own radiation which can be received in an acceptor 15, for e.g. on the light sensitive cells of a diode sensor array to produce signals which can be appropriately evaluated. In this case, the sender 14 can be eliminated from the system, since the body provides its own radiation.

The one or more acceptors 15 that are employed, are connected to a controller 13. The signals received by the acceptor or acceptors 15 which characterize the diameter of the body 5, are utilized by the controller 13 in the controller circuit and are utilized for producing a control driving signal. This signal can actuate appropriate control devices at an early stage in the process, since the formation of the diameter of the rotating body takes place immediately beneath the level 4 of the sprayed metal. The formed diameter of the body is determined by the distance of the level 4 of the sprayed metal from the spraying orifice 2, and also by the tilting angle $\alpha$ of the spray head. Thus, when for a given distance of the level 4 from the spraying orifice the diameter of the formed body is too small or too large, the distance between the level 4 and the orifice has to be reduced or increased to eliminate the departure of the formed diameter from that which is desired. The formed diameter is determined not only by the position of the level 4, but also by the downward drawing speed of the spray receiving surface 3 by its supporting rod 6.

The apparatus and process of the present invention can detect a change in the measured values sufficiently early during the formation of the diameter from the melt, and the controlled process parameter regulation can take sufficiently early for a correction. When a change in the diameter signal shows a tendency for the diameter to become larger, this tendency can be counteracted by lowering the position of the level 4 and/or varying the downpull rate of the surface 3 by the rod 6.

Through the constant and simultaneous measurement of the diameter a measure of regulation is available during the process, which permits the compensation for spraying parameter variations which cannot be, or not easily be regulated, to adapt the process to the spray conditions prevailing at any given time.

We claim:

1. A method for producing a rotationally symmetrical body from a molding material, such as a molten metal, which comprises atomizing the molding material in liquid form through a spraying nozzle that is disposed relative to a spray receiving surface for receiving the sprayed molding material on an initial position of said surface, forming a level of liquid molding material on said spray receiving surface forming a controllably rotating body of said liquid molding material while it is solidifying, said solidifying rotating body having a diameter, drawing the so-formed body downwardly from said initial position while continuing its rotation, continuously forming said body at said initial position, monitoring the momentary diameter of the rotating body at a plane adjacent to said initial position, and controlling said rotation by said momentary diameter.

2. The method of claim 1, wherein said molding material is a metal.

3. The method of claim 2, further comprising conducting said diameter values to a controller, and regulating the diameter of the body being formed by adjusting the amount of the molten material at said initial position.

4. The process of claim 3, wherein the controller is preprogrammed with said values and with the required amounts of molten metal corresponding to said values, at said position.

5. Apparatus for producing a rotationally symmetrical body from a molding material, such as molten metal, comprising a container for molding material, a spray orifice for atomizing molding material, a rotatable spray receiving surface spaced from said orifice for receiving the atomized molding material, a chamber surrounding said orifice and said spray receiving surface, means for determining the level of the spray receiving surface, means for monitoring the diameter of the forming body, and a controller, each of said means for determining and said means for monitoring being connected to said controller.

6. The apparatus of claim 5, wherein said means for monitoring comprises a light beam projecting in a direction parallel to the initial position of said spray receiving surface.

* * * * *